US007086121B2

(12) United States Patent
Lippincott

(10) Patent No.: US 7,086,121 B2
(45) Date of Patent: Aug. 8, 2006

(54) NON-REMOVABLE SNAP FASTENER USED TO ATTACH A PACIFIER, TEETHING RING, TOY OR OTHER ARTICLE TO ANY GARMENT OF CHILDREN'S CLOTHING

(76) Inventor: Pamela A. Lippincott, 9000 Bramblewood Way, Elk Grove, CA (US) 95758

( * ) Notice: Subject to any disclaimer, the term of this patent is extended or adjusted under 35 U.S.C. 154(b) by 11 days.

(21) Appl. No.: 10/857,220

(22) Filed: May 27, 2004

(65) Prior Publication Data

US 2004/0244153 A1 Dec. 9, 2004

Related U.S. Application Data

(60) Provisional application No. 60/476,585, filed on Jun. 6, 2003.

(51) Int. Cl.
*A44B 21/00* (2006.01)
*A61J 17/00* (2006.01)
*A41D 1/00* (2006.01)

(52) U.S. Cl. ..... 24/3.13; 24/302; 606/234; 2/1; 2/102

(58) Field of Classification Search ..... 24/298, 24/302, 3.13; D24/195; 606/234, 236; 2/102, 2/323, 1; 446/227
See application file for complete search history.

(56) References Cited

U.S. PATENT DOCUMENTS

| | | | | |
|---|---|---|---|---|
| 2,827,055 | A * | 3/1958 | Carden | D24/195 |
| 3,392,729 | A * | 7/1968 | Lenoir | 24/3.13 |
| 4,765,037 | A * | 8/1988 | Perry | 24/3.13 |
| 4,985,968 | A * | 1/1991 | Hooper | 24/302 |
| 4,990,157 | A * | 2/1991 | Roberts et al. | 606/234 |
| 5,150,504 | A * | 9/1992 | Cohen | 24/302 |
| 5,815,834 | A * | 10/1998 | Bronson | 2/102 |
| 6,312,449 | B1 * | 11/2001 | Chang et al. | 606/234 |
| 6,442,759 | B1 * | 9/2002 | Straham et al. | 2/49.2 |

* cited by examiner

*Primary Examiner*—Robert J. Sandy

(57) ABSTRACT

A non-removable snap fastener used to attach a pacifier, teething ring, toy or other article to any garment of children's clothing. It is comprised of a non-removable female part of a snap fastener, which is attached to any garment of children's clothing, and preferably, though not necessary for effectiveness, incorporated into a decoration of flowers, animals, toys or any other attractive decoration for any garment of children's clothing, created using embroidery, appliqué, needlepoint or other craft. The corresponding male part of the snap fastener is attached to one end of a strap, having both female and male parts of a snap fastener attached to the other end of the strap, which is used to secure the article onto the strap for the child's use. It is unique in being a safe, effective and attractive means for providing a child with ready access to articles that aid in fulfilling the sucking need of children, providing uninterrupted sleep, relieving the pain of teething and providing amusement and interest for the child.

8 Claims, 2 Drawing Sheets

NON-REMOVABLE SNAP FASTENER USED TO ATTACH A PACIFIER, TEETHING RING, TOY OR OTHER ARTICLE TO ANY GARMENT OF CHILDREN'S CLOTHING

This Application is based upon provisional U.S. patent application Ser. No. 60/476,585, filed on Jun. 6, 2003.

BACKGROUND OF THE INVENTION

This invention relates to a snap fastener that is non-removable and used to attach a pacifier, teething ring, toy or other article to any garment of children's clothing. The preferred embodiment, although not necessary for effectiveness, is having the non-removable female part of the snap fastener incorporated into a decoration of flowers, animals, toys, or other attractive decoration for any garment of children's clothing, created using embroidery, appliqué, needlepoint or other craft. The corresponding male part is attached to one end of a strap, having both a male and a female part on the other end of the strap, for attaching a pacifier, teething ring, toy or other article for use by a child.

There are a considerable number of devices in existence to make articles available to a child, but all are lacking in one or more of the characteristics of ease of access, benefit or safety to a child. These existing devices are in five categories, although some could properly be considered in more than one category, as follows: (1) removable fasteners, (2) pacifier straps, (3) pacifier clips, (4) pacifier holders and (5) combinations.

Two removable fastener devices are U.S. Pat. No. 4,985,968, Fastener means for pacifiers, toys, badges and like articles and U.S. Patent D309,280, Pacifier coupler for baby's garment. The former patent is a removable snap fastener comprised of a female part, which opens into two pieces, one of which is placed on the inside of the garment and the other placed on the outside of the garment, and the two pieces are pressed together, forming the removable female part of the snap fastener. The corresponding male snap fastener part, attached either to a strap for a toy, pacifier or other like article or attached to the back of an article, as on a badge, can be inserted into this. The latter patent is a removable coupler comprised of a disk, having a protrusion and a coupler with a raised strip for inserting a strap, which fits over this protrusion. The disk is placed on the inside of the garment, the coupler on the outside, and when they are pressed together, securing the coupler to the garment, a strap may be inserted into the raised strip for attaching a pacifier. The disadvantages of these devices are the possibility of the removable part opening for a child to swallow, the piercing of the material into which the removable part is inserted, the inconvenience of having to remove the device for placing on different garments and the possibility of losing one or more of the removable parts, while doing this.

Two pacifier straps are U.S. Patent D415,837 Pacifier securement strap and D326,917 Retaining strap for pacifier clip to clothing. The former is a strap with velcro sewn to each end, which could be inserted through the loop of a pacifier and used to attach the pacifier to a toy, purse or other article having an opening through which to insert the strap. The latter is a strap having an enlargement on one end and a loop on the other end, which is attached through a hole to a clip. A pacifier could then be put on the strap, and the enlarged end inserted through the loop end to secure the pacifier. The D415,837 patent does not provide ease of access and also lacks benefit to the child, as it's attached to something else and not readily available when needed. The D326,917 patent is a strap that could easily be pulled open by the child losing the benefit of having the pacifier available. This patent is also a clip attachment device that can easily pinch, even rupture, the skin when attached, tear the clothing to which it is attached and be pulled loose by the child.

Pacifier clips all have the inherent problems mentioned in the previous paragraph, although they are widely used at this time. U.S. Patent D369,217 Combined spring and clip pacifier holder, U.S. Patent D341,891 Clip for a pacifier, U.S. Patent D314,430 Clip for use with a pacifier, U.S. Pat. No. 4,903,698 Pacifier strap and fastener for attachment to a garment and U.S. Pat. No. 4,765,037 Pacifier strap are all pacifier clip devices. The D369,217 patent is a disk with a clip on the back and a spring hanging from the bottom of the disk to attach a pacifier. The spring is not long enough to make the pacifier accessible to the child and could easily become detached, creating a choking hazard to the child. The D341,891 patent is a clown disk with a clip on the back and a two pronged receptacle on the bottom for attaching a pacifier. Again, the pacifier is not readily accessible to the child, as it's engaged in the receptacle, and could easily become detached and not of benefit to the child when needed. The D314,430 patent is a cat's head disk with a slit clip incorporated into the cat's hat and a circular opening at the bottom for attaching a pacifier using a strap. This slit style clip would very easily become detached and be a constant source of annoyance to the child, rather than a soothing influence. The U.S. Pat. No. 4,903,698 is a disk with a clip on the back and a small protrusion on the bottom front. An elongated, flat strap, having a slit at both ends and a small protrusion on one end, is attached over the protrusion to the disk and to the pacifier by looping the strap through the pacifier and securing the slit in the strap to the small protrusion on that end of the strap. The strap could also easily become detached from the disk and be unavailable to the child when needed. The U.S. Pat. No. 4,765,037 is the most widely used form of a pacifier clip device. A strap, with snaps, and sometimes velcro, on one end, is attached on the other end to a clip, through insertion of that end of the strap into a rectangular, open metal piece in the clip and sewing that end to the strap, and a pacifier is attached to the other end of the strap by looping that end through a pacifier and closing the snap fastener. Velcro deteriorates over time, causing the pacifier to be easily disengaged from the strap, making the pacifier of no benefit to the child. As a clip pacifier device, it can easily pinch, even rupture, the skin when attached, tear the clothing to which it is attached and be pulled loose by the child, i.e. the inherent weaknesses of all clip pacifier devices.

There are a large number of pacifier holders that have been patented, but D318,122 Pacifier holder and D326,918 Pacifier holder are those that are of interest, as they are bibs, which attach the pacifier to something the child is wearing. Both were patented by the same inventor, the later patent being a bib constructed of a conventional fabric, rather than the lace-like fabric patented in the earlier invention. The bib is secured around the child's neck by means of snaps, and the lower portion of the bib is folded upwards, inserted through a pacifier ring and snapped, securing the pacifier to the bib. The pacifier would only be of benefit to the child if the bib was being worn, which is conventionally a garment worn when the child is eating, and not particularly attractive to be worn at other times.

Two combination devices, which attach the pacifier to something the child is wearing, are U.S. Pat. No. 4,604,758 Safety bib for engaging a pacifier and U.S. Pat. No. 5,131, 096 Versatile child's garment. The U.S. Pat. No. 4,604,758 is similar to the pacifier holders discussed in the previous paragraph, and presents the same problems, as it is a bib with a pacifier attached, the difference being the pacifier is attached using a strap sewn to the bottom of the bib at one end and having a snap closure to secure the pacifier at the other end. The U.S. Pat. No. 5,131,096 is a multiple use garment for use by a child from infancy through the toddler age. The pacifier is secured to the garment by a strap secured into the pocket of the front of the garment. Again, it is unconventional and impractical for a child to wear this garment at all the times that the pacifier might be needed by the child.

BRIEF SUMMARY OF THE INVENTION

This invention is a non-removable snap fastener used to attach a pacifier, teething ring, toy or other article to any garment of children's clothing. The non-removable female part of the snap fastener may be, although not necessary for effectiveness, incorporated into a decoration of flowers, animals, toys, or other attractive decoration for any garment of children's clothing, created using embroidery, appliqué, needlepoint or other craft. The corresponding male part of the snap fastener is attached to one end of a strap, which contains both male and female snap fastener parts on the other end, for attaching the various articles.

The pacifier, teething ring, toy or other article is easily accessible to the child; there are no loose parts to be a safety hazard for the child; and, the child experiences the benefits of having their sucking need readily fulfilled, assistance in sleeping through the night, having the pain of teething alleviated and having amusement readily accessible.

DETAILED DESCRIPTION OF THE INVENTION

Figure 1:
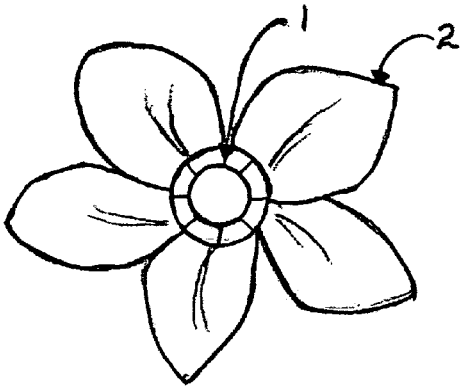
FIG. 1. is a front view of the non-removable female part 1 of the snap fastener, incorporated into a flower decoration 2 to be crafted onto any garment of children's clothing.
Figure 2:
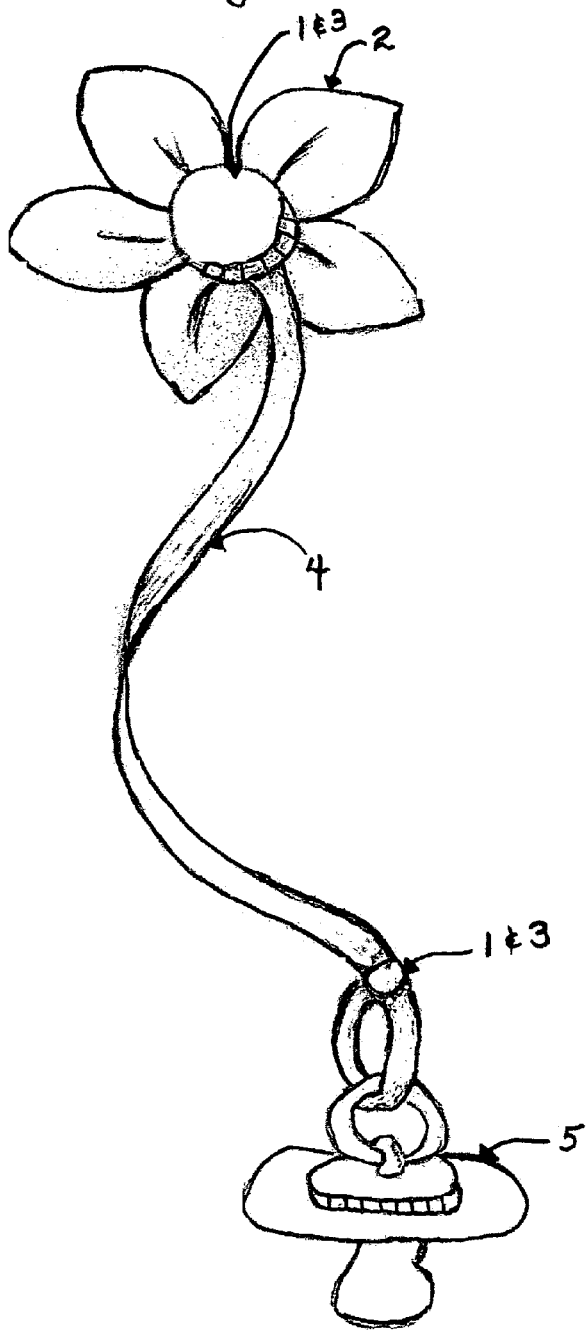
FIG. 2. is a front view of both the non-removable female part 1 (not visible) of the snap fastener and the corresponding male part 3, which are attached together and the female part 1 (not visible) is incorporated into a flower decoration 2 that could be crafted onto any garment of children's clothing. The male part 3 is attached to one end of a strap 4, having both male 3 and female 1 (not visible) parts attached to the other end of the strap 4. A pacifier 5 is attached to the strap 4 by pulling the male part 3 out of the female part 1, looping the strap 4 through the pacifier 5 and placing the male part 3 back into the female part 1 (not visible).
Figure 3:
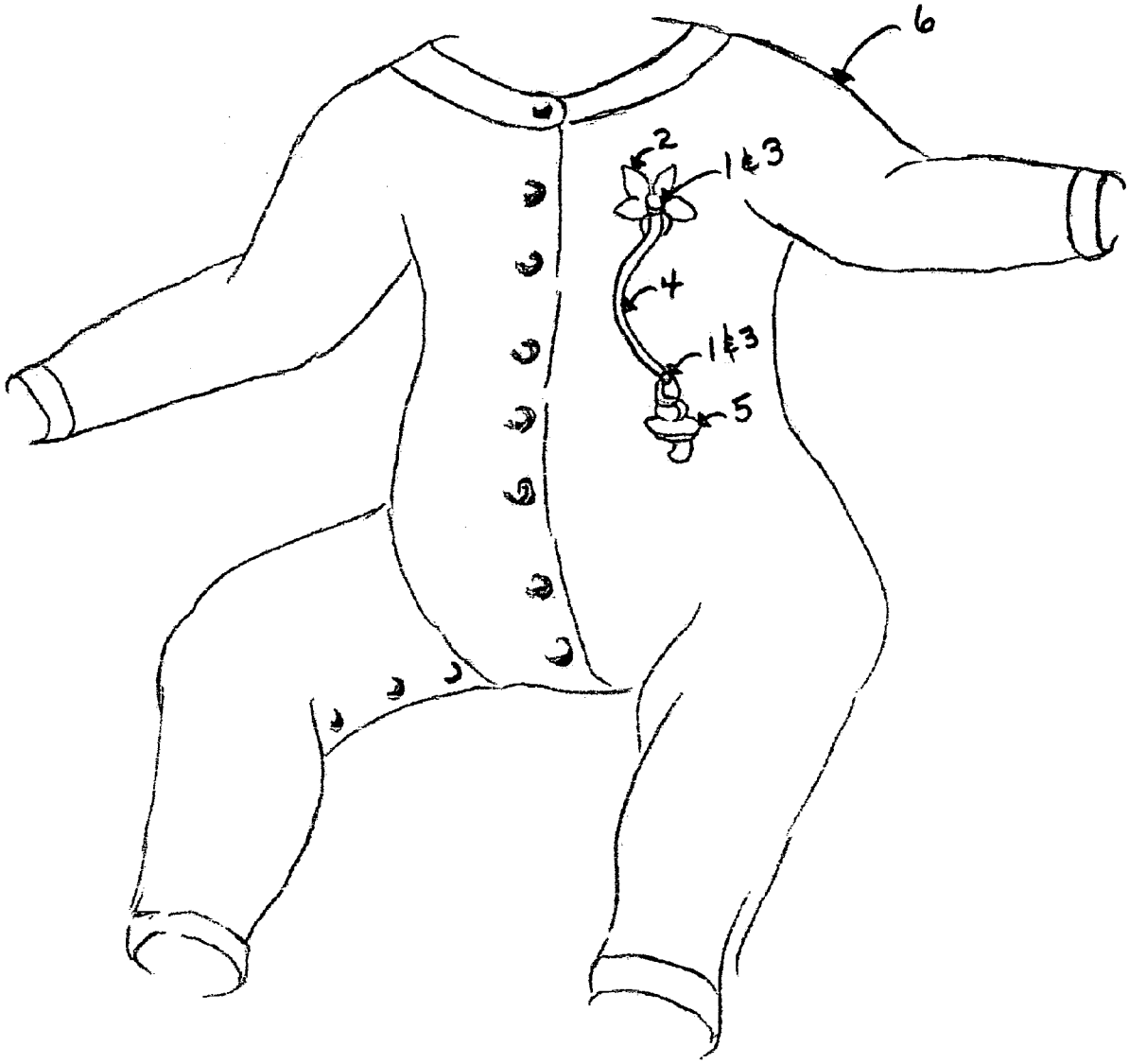
FIG. 3. is a front view of a children's garment of clothing (sleeper) 6 having the non-removable female part 1 (not visible) of the snap fastener crafted into a flower decoration 2. The corresponding male part 3 is attached to one end of a strap 4, which has both male 3 and female 1 (not visible) parts attached to the other end of the strap 4. A pacifier 5 is attached to the strap 4 as described in FIG. 2.

This invention is a non-removable snap fastener used to attach a pacifier, teething ring, toy or other article to any garment of children's clothing. The preferred embodiment, although not necessary for effectiveness, is having the non-removable female part of the snap fastener incorporated into a decoration of flowers, animals, toys, or other attractive decoration for any garment of children's clothing, created using embroidery, appliqué, needlepoint or any craft, which creates a decoration capable of being attached anywhere on children's clothing, although generally on the front. The corresponding male part of the snap fastener is attached to a strap, having both female and male parts of a snap fastener attached to the other end. The preferred construction of the snap fasteners, although not necessary for effectiveness, is metal covered with plastic, on both the female and male parts, which is color coordinated to the surrounding decoration, if any. The male part of the snap fastener on one end is inserted into the female part of the snap fastener on the garment of children's clothing, and a pacifier, teething ring, toy or other article is attached to the other end of the strap by looping the strap through the device and inserting the male part into the female part of the snap fastener on the strap.

Using this invention, the pacifier, teething ring, toy or other article is readily accessible to the child, whenever needed. This provides undisturbed sleep and reduces frustration for the child and the parents, as children often lose their pacifier during the night or at naptime. It is an aid in fulfilling the sucking need of children, scientifically proven to be necessary at birth, for survival, and be persistent if not fulfilled. It also aids in reducing the pain and frustration of teething for young children, if a teething ring is attached to the strap. And, for anyone whom has ever constantly retrieved a toy or other article dropped by a child, amusement and interest for the child are always available just by the child or an adult retrieving the article using the strap, if the article is dropped. The strap is long enough, approximately 10 inches, for the attached article to be comfortably played with or inserted into the child's mouth, but it is not so long as to be a safety hazard.

There are many unique features of this invention, safety being among the most important. Since the female portion of the snap fastener, which is attached to the garment of children's clothing, is non-removable the choking hazard of removable devices and the frustration of losing a removable part are eliminated. The dangers of pinching or rupturing the child's skin, using a pacifier clip, are also eliminated, and the plastic coating on both the female and male parts of the non-removable snap fastener provides smoothness against the child's skin. When the female portion of the snap fastener is incorporated into the design and color matched to any decoration crafted on a garment of children's clothing, it is a uniquely attractive means of attaching a pacifier, teething ring, toy or other article to the clothing. And, additionally, if the child fulfills the need for such articles before outgrowing the clothing, the clothing is still attractive for wearing.

I claim as my invention:

1. In combination with a garment of children's clothing, having a front side with a flower affixed thereto as part of the garment, a safety strap device comprising:

a first snap fastener comprising male and female parts, said female part being non-removably incorporated in said flower as the center thereof;

an elongated strap, said male part being attached to one end of said strap to secure the strap to the garment of clothing upon engagement with said female part;

and, a second snap fastener comprising male and female parts, secured to the other end portion of said strap and spaced apart thereon to form a releasable loop in the strap, when engaged, for holding a pacifier.

2. The combination defined in claim 1, wherein the flower is a type selected from the group comprising an embroidery, an appliqué and a needlepoint and said female part of said first snap fastener forms a round center of the decoration.

3. The combination defined in claim 1 wherein the flower or other attractive decoration is colorful and said female part of said first snap fastener is composed of metal and covered with plastic that is color coordinated with the flower decoration.

4. In combination with a garment of children's clothing having on one side a decoration affixed thereto as part of the garment, a safety strap device comprising;

a first fastener comprising two releasable, engageable parts, one of said parts being non-removably incorporated in said decoration as an element thereof;

an elongated strap, the other part of said first fastener being attached to one end of said strap to secure the strap to the garment of clothing upon engagement with said one part;

and, a second fastener comprising two releasable, engageable parts secured to the other end portion of the strap and spaced apart thereon to form a releasable loop in the strap when engaged for holding a child's implement.

5. The combination defined in claim 4 wherein said decoration is a representation selected from the group comprising a flower, an animal, and a toy, and said one part forms an element of the decoration.

6. The combination defined in claim 4 wherein the decoration is a type selected from the group comprising an embroidery, an appliqué and a needlepoint.

7. The combination defined in claim 4 wherein at least one of said fasteners is a snap fastener comprising male and female parts.

8. The combination defined in claim 7 wherein the decoration is a flower and said female part of said first fastener is non-removably secured to said decoration as the center of the flower decoration.

* * * * *